United States Patent [19]

Goodwin

[11] Patent Number: 4,677,912

[45] Date of Patent: Jul. 7, 1987

[54] INK FOUNTAIN PREPARATION STATION AND INTERCHANGEABLE INK FOUNTAIN SYSTEM

[75] Inventor: Eber L. Goodwin, Arlington Heights, Ill.

[73] Assignee: AM International, Inc., Chicago, Ill.

[21] Appl. No.: 723,794

[22] Filed: Apr. 16, 1985

[51] Int. Cl.[4] ..... B41F 31/06; B41F 31/30

[52] U.S. Cl. ..... 101/365

[58] Field of Search ..... 101/365, 349, 350, 351, 101/352, 363, 364, 207, 208–240

[56] References Cited

U.S. PATENT DOCUMENTS

| | | | |
|---|---|---|---|
| 3,186,336 | 6/1965 | Kirby | 101/216 |
| 3,390,633 | 7/1968 | Boughton | 101/216 |
| 3,500,745 | 3/1970 | Neal | 101/207 |
| 3,958,509 | 5/1976 | Murray et al. | 101/350 X |
| 4,008,664 | 2/1977 | Crum et al. | 101/365 |
| 4,137,843 | 2/1979 | Ottenhue | 101/216 |
| 4,522,057 | 6/1985 | Kerchiss | 73/150 R |

*Primary Examiner*—J. Reed Fisher

*Attorney, Agent, or Firm*—Nicholas A. Camasto; John R. Hoffman

[57] ABSTRACT

An interchangeable ink fountain system for use in duplicating machines, such as offset lithographic machines. A plurality or set of ink fountains is provided for removable mounting on either a duplicating machine or a preparation station. Complementary interengaging supports are provided on each ink fountain and each of the duplicating machine and preparation station for selectively and removably mounting an ink fountain on either the duplicating machine or the preparation station. The preparation station includes a housing and light means in the housing behind the ink fountain for directing light through the ink flow through gap of the empty fountain, whereby an operator can readily visualize the gap dimensions while adjusting the same.

26 Claims, 9 Drawing Figures

FIG. 4
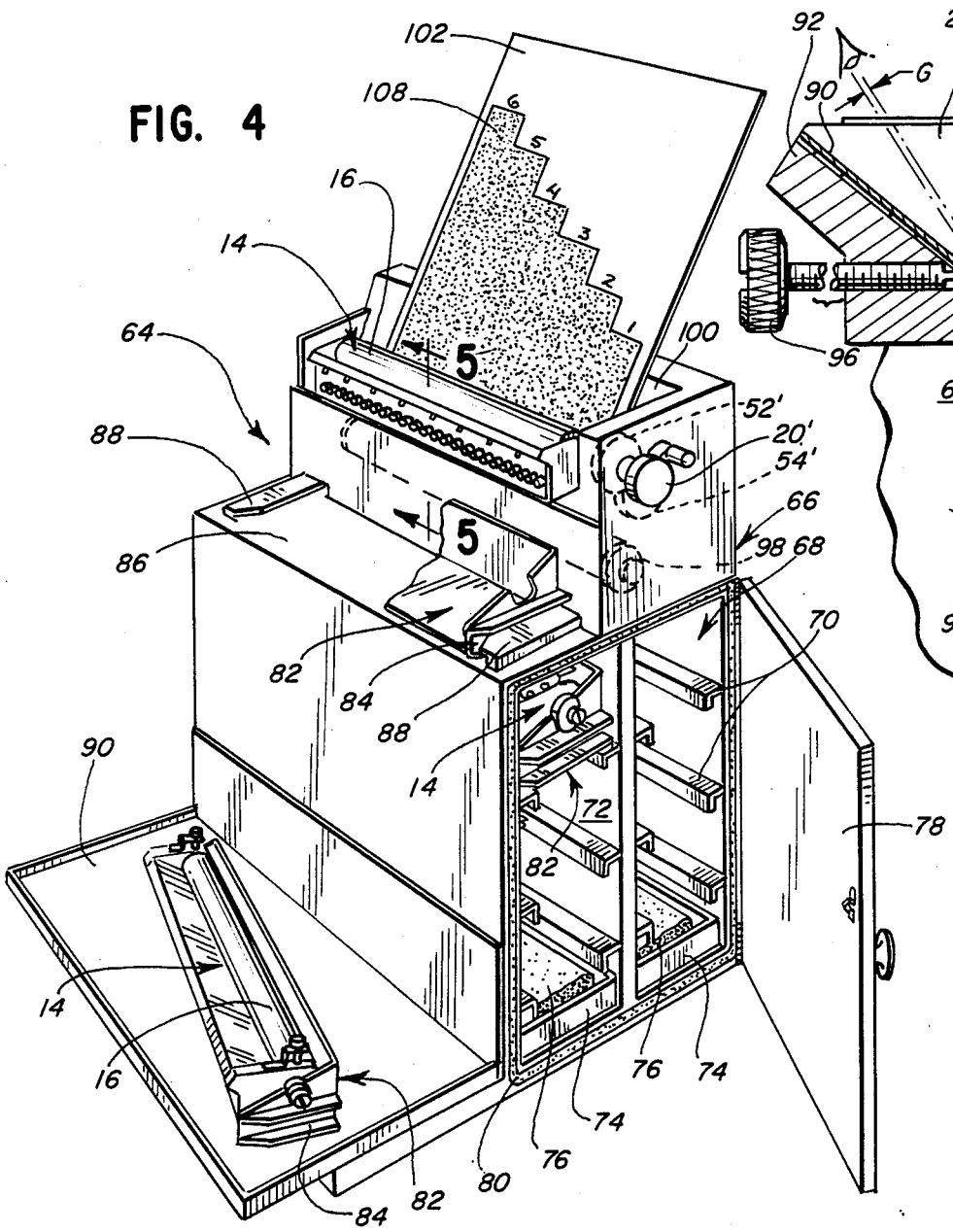
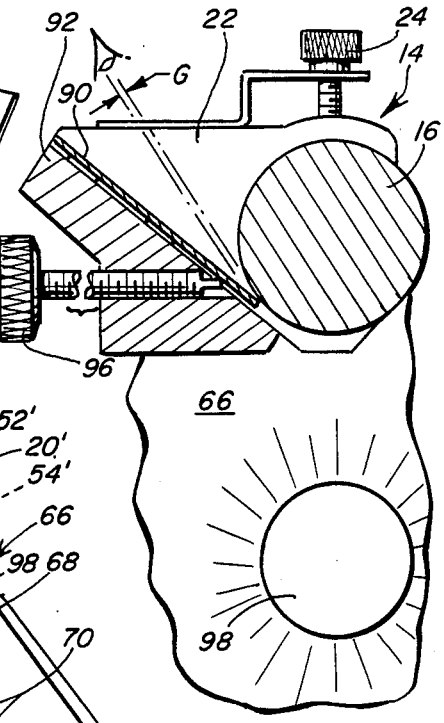
FIG. 5
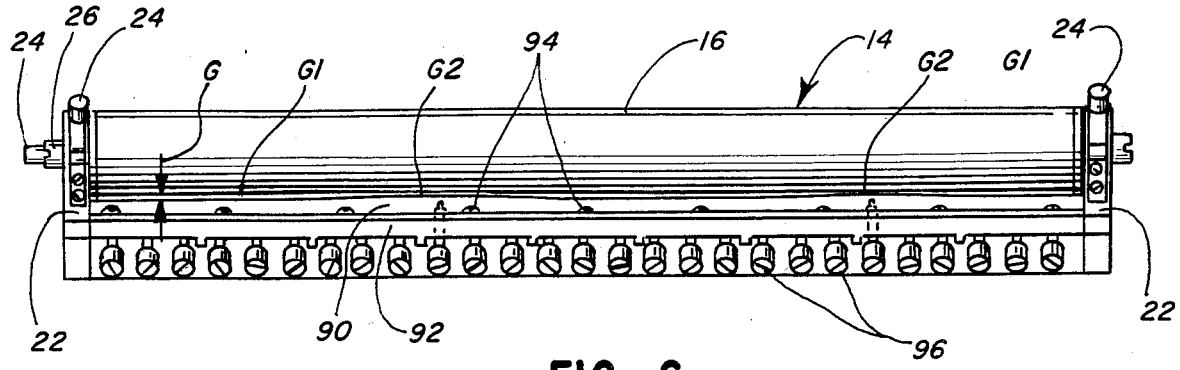
FIG. 6

FIG. 7
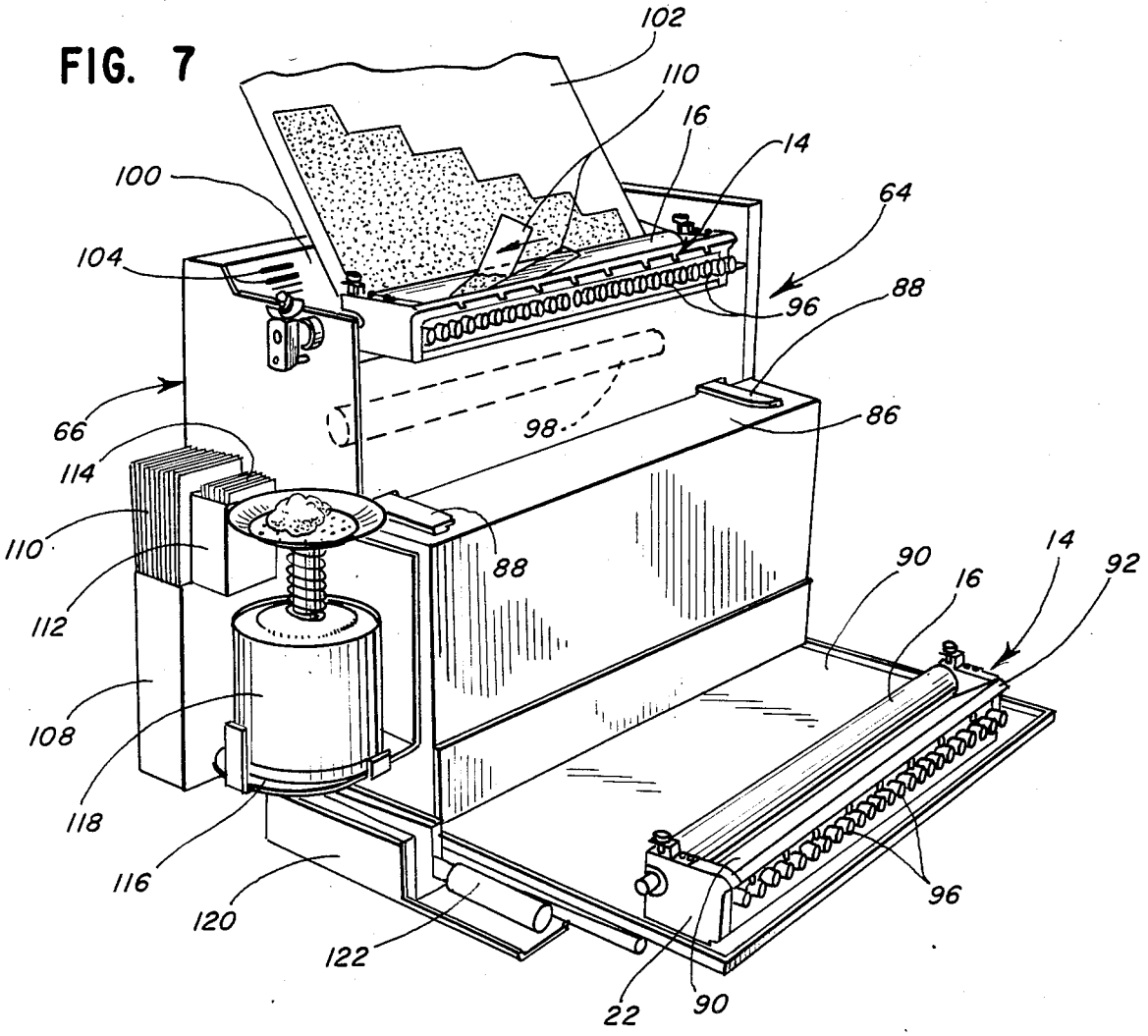
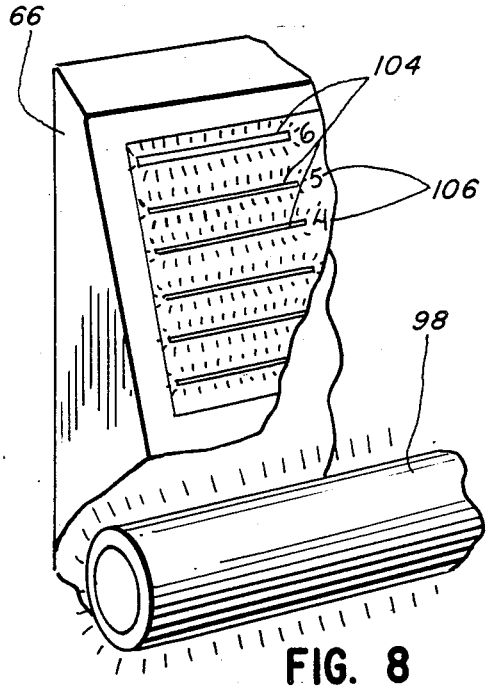
FIG. 8
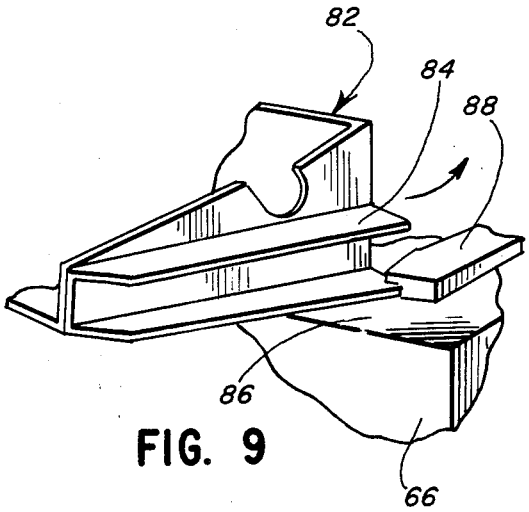
FIG. 9

INK FOUNTAIN PREPARATION STATION AND INTERCHANGEABLE INK FOUNTAIN SYSTEM

BACKGROUND OF THE INVENTION

This invention relates generally to duplicating machines and, more particularly, to ink fountain assemblies for use in duplicating machines. Specifically, the invention relates to a preparation station for ink fountains and the use of a preparation station in a system utilizing interchangeable ink fountains.

Printing machines, such as rotary offset lithographic duplicating machines, normally include a printing couple which comprises a number of cylinders and/or rollers such as impression cylinders, master cylinders, blanket cylinders, ductor rollers, regulator rollers, and the like. An ink fountain is disposed at the rear end of the machine for feeding ink to the various rollers of the printing couple which transfers images to copy sheets.

Conventional ink fountain assemblies normally take the form of a fountain trough defined by an elongated blade extending along one side and an ink fountain roller extending along the opposite side of the trough. The ink fountain roller transfers the ink to the other rollers of the printing couple. The blade is adjustable by a plurality of thumb screws to vary the gap between an edge of the blade and the ink fountain roller. In some instances, the gap is maintained of generally equal dimensions along its length to maintain consistency in the amount of ink applied to the roller uniformly along the length of the roller. However, in many instances the width of the gap varies along its length depending upon the amount of ink necessary to duplicate a given master having varying densities of a particular ink color.

One of the major problems encountered in printing or duplicating systems described above is the down time required to change types of inks. In the printing industry it is a common practice to change colors of ink, such as in a four-color offset lithographic duplicating machine. The type of ink, such as rubber base ink, oil base ink or electrostatic ink also is changed, as with fast drying inks for hard surface paper stock or slower drying inks for general paper stock. This problem is becoming increasingly prevalent due to the industry shifting from a high percentage of black ink printing to higher quality work of various colors and color processes.

High hourly labor rates require that strong consideration be given to reducing press down time in changing ink colors or types. Each time the ink is changed for a given run of stock, not only does the ink in the fountain have to be changed and the fountain itself cleaned for a subsequent ink color or type, but the rollers of the printing couple also must be cleaned with a solvent. However, cleaning the printing couple rollers takes considerably less time than changing the ink in the fountain and cleaning the fountain. In fact, the printing couple rollers can be cleaned during continuous running in a basic time of approximately 70 seconds. It would be desirable to be able to simply bodily remove the previous ink fountain during this short clean-up time and replace the entire fountain with one that already has been cleaned and fully prepared with a new type or color of ink.

This invention is directed to providing a novel ink preparation station for ink fountains in a system which permits complete interchangeability of ink fountains between the duplicating machine and the preparation station. In this manner, a subsequent ink fountain assembly can be completely prepared with a different color or type of ink, including adjusting the ink flow through gap, so that the fountain is ready for immediate interchangement onto the duplicating machine when the previous run is completed.

SUMMARY OF THE INVENTION

An object, therefore, of the invention is to provide a novel preparation station for ink fountains used in duplicating machines, such as rotary offset lithographic machines.

Another object of the invention is to provide an interchangeable ink fountain system for use in such duplicating machines.

Normally, such ink fountains include a fountain trough defined by an elongated blade, an ink fountain roller and means for adjusting the ink flow-through gap between the blade and roller.

In the exemplary embodiment of the invention, the preparation station includes a housing with support means for removably mounting an ink fountain on the housing in position for ready access to the adjusting means. Light means are provided on the housing behind the ink fountain for directing light through the gap between the blade and roller, whereby an operator can readily visualize the gap dimensions while adjusting the same. Drive means are provided on the housing for rotating the ink fountain roller when mounted on the housing. The drive means include motor means for power driving the roller. Therefore, after the ink flow through gap has been properly adjusted, the fountain can be filled with ink for the next succeeding printing run and the fountain roller rotated to maintain consistency of the ink. Should it be necessary to add varnish, reducer or other components to the ink, rotation of the fountain roller is effective to properly mix the ink components prior to a subsequent printing run. This also greatly reduces machine down time. A manually operable drive means also is provided, independently of the motor drive means, for fast rotation of the fountain roller during cleaning of a previous ink supply.

Other features of the ink fountain preparation station include easel means on the housing adjacent the ink fountain for supporting a master, test plate or the like, whereby an operator can readily compare the ink flow through gap dimensions with the ink requirements of the master. Gauge means also are provided on the housing for comparison by an operator with the gap dimensions of the ink fountain. As disclosed herein, the gauge means comprise a plurality of window-like slots in the housing with the light means therebehind, the slots being of varying widths. A plurality of utensil holders also are provided on the outside of the housing for supporting various implements used in preparing an ink fountain for operation.

Another feature of the preparation station is the provision of an enclosure within the housing for storing a plurality of ink fountains when not in use. The enclosure includes a plurality of open shelves for supporting the ink fountains. Moisture means are provided in the enclosure to prevent any ink in a stored ink fountain from drying. An access door is provided to the enclosure, with sealing means about the access door to contain moisture within the enclosure.

The invention contemplates an interchangeable ink fountain system for use in duplicating machines, such as offset lithographic machines. The system includes a plurality or set of ink fountains, a duplicating machine, a preparation station, and complementary interengaging means on each ink fountain and each of the duplicating machine and preparation station for selectively and removably mounting an ink fountain on either the duplicating machine or the preparation station. The preparation station of such a system incorporates all of the features described above.

In addition, tray-like holders are provided for carrying an ink fountain between the preparation station and the duplicating machine. Platform means are provided on the front of the station housing, with rail means for positioning the tray-like holder on the platform means, whereby the ink fountain can be readily removed from the holder and positioned on the housing for adjustment, cleaning, and filling. The shelves within the housing enclosure are adapted for receiving the tray-like holders.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 4 is a perspective view of the ink fountain preparation station of the invention;

FIG. 5 is a fragmented vertical section, on an enlarged scale, taken generally along line 5—5 of FIG. 4;

FIG. 6 is a top plan view of an ink fountain assembly;

FIG. 7 is a perspective view of the ink fountain preparation station, looking at the opposite side of FIG. 4;

FIG. 8 is a fragmented perspective view, on an enlarged scale, illustrating the gauge means on the preparation station; and FIG. 9 is a fragmented perspective view illustrating the interconnection between an end of an ink fountain transport tray and the rail means on the preparation station.

DETAILED DESCRIPTION OF THE PREFERRED EMBODIMENT

Figure 1:
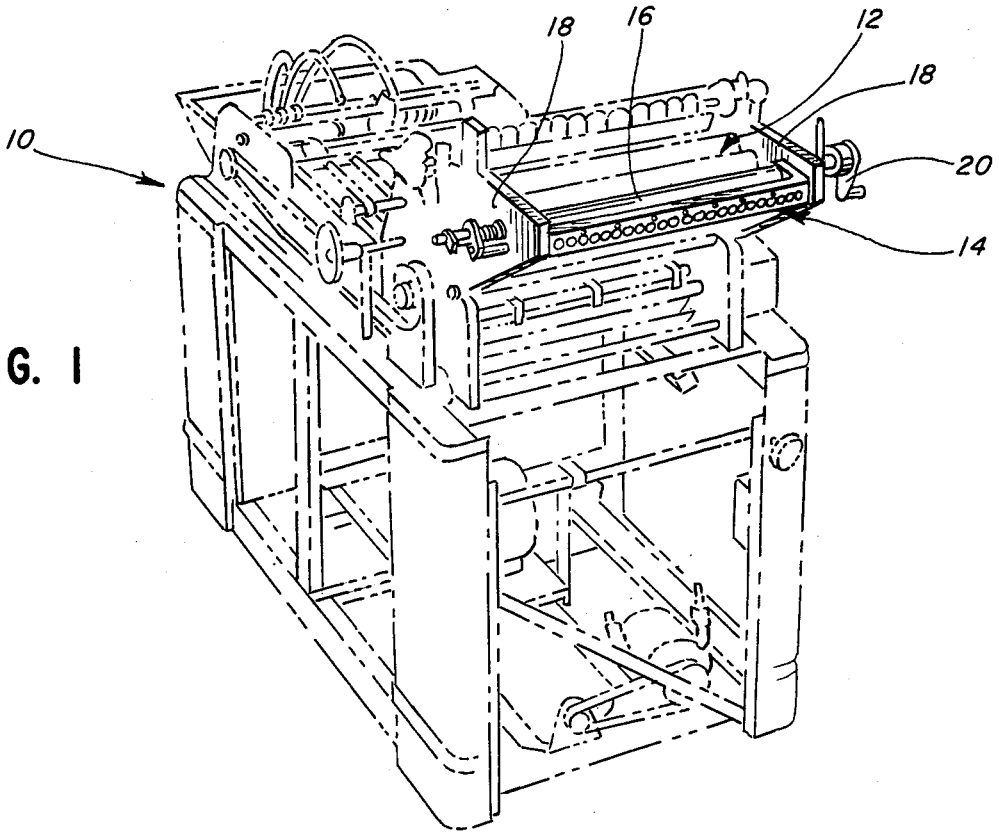
FIG. 1 is a perspective view of a rotary offset lithographic machine, shown in phantom, incorporating an ink fountain assembly at the top, rear of the machine.

Referring to the drawings in greater detail, and first to FIG. 1, a conventional rotary offset lithographic duplicating machine is shown in phantom and generally designated 10. The machine has a standard printing couple, generally designated 12, which includes conventional cylinders and rollers for feeding ink through the couple and transferring images to copy sheets. An ink fountain assembly, generally designated 14, is disposed at the head of the printing couple and includes an ink fountain roller 16 disposed between a pair of side braces 18. A hand crank 20 is provided for manually rotating fountain roller 16 independent of automatic rotation of the fountain roller during operation of the machine.

Figure 2:
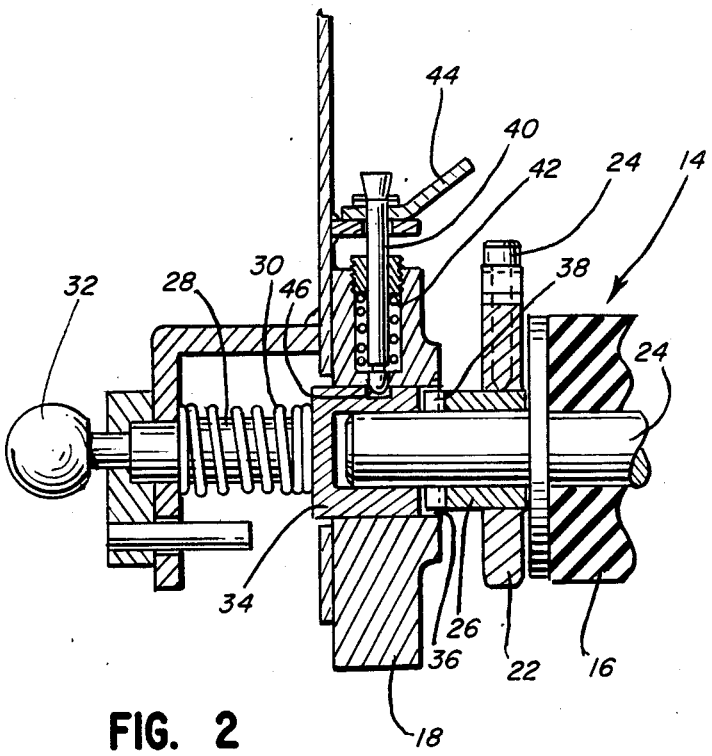
FIG. 2 is a vertical section, on an enlarged scale, of the interengaging means between the duplicating machine and the left-hand end of an ink fountain assembly.
Figure 3:
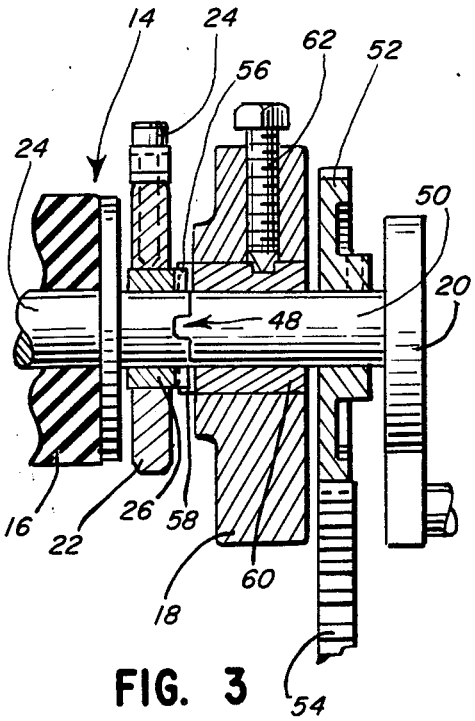
FIG. 3 is a vertical section, on an enlarged scale, of the interengaging means between the duplicating machine and the right-hand end of an ink fountain assembly.

FIGS. 2 and 3 show the complementary interengaging means between the left-hand and right-hand ends, respectively, of the ink fountain assembly and the duplicating machine. Fountain roller 16 is sandwiched between end walls 22 of ink fountain assembly 14. The fountain roller includes a central axle or shaft 24 projecting from opposite ends thereof. End walls 22 of the ink fountain assembly are locked by set screws 24 to locating bushings 26 through which roller shaft 24 is journalled.

Referring to FIG. 2, a manually operable plunger 28 is spring loaded by a coil spring 30 for biasing the plunger to the right as viewed in FIG. 2. A knob 32 is secured to the outside, distal end of plunger 28 for manually grasping and pulling the plunger outwardly against the force of spring 30. A cap 34 is formed on the inside end of plunger 28 and includes locator slots 36 for receiving locator tabs 38 on bushing 36. This helps insure that the ink fountain is in proper orientation when mounted on the machine. To further insure proper orientation, a spring loaded locking pin 40 is raised and lowered against the biasing of a spring 42 by means of a thumb tab 44. The locking pin seats in a locator notch 46 in cap 34 on the inner end of plunger 28. When it is desirable to remove ink fountain assembly 14 and replace the fountain with a newly prepared fountain, thumb tab 44 is raised to pull locking pin 40 out of notch 46. This permits plunger 28 to be pulled outwardly by grasping knob 32. Outward movement of the plunger releases the engagement between locator tabs 38 and also substantially releases the left-hand end of fountain roller shaft 24.

Turning to FIG. 3, the right-hand end of fountain roller assembly 14 also is similarly removably mounted on the duplicating machine.

More particularly, fountain roller shaft 24 is driven by a tongue-and-groove connection, generally designated 48, with a stub shaft 50. The stub shaft is integral with a gear 52 which is in mesh with a power driven gear 54 to automatically rotate the fountain roller during operation of the machine. Like the left-hand end of the roller, bushing 26 has locator tabs 56 positionable within locator slots 58 to insure that the ink fountain, through end walls 22, is properly oriented in the machine. Slots 58 are formed in an interior bushing 60 properly located and locked within side brace 18 by a set screw 62. It can be seen that when the left-hand end of the ink fountain assembly is released by lifting thumb tab 44 and pulling on spring loaded plunger 28, as described in relation to FIG. 2, the disengagement (at 48 and 56) of the right-hand end of the ink fountain assembly is easily accomplished and the assembly can be readily removed and interchanged with a similar ink fountain assembly that has been cleaned, adjusted and loaded with ink at the ink fountain preparation station of this invention described hereinafter.

Referring to FIG. 4, an ink fountain preparation station is illustrated and generally designated 64. The station includes a composite housing, generally designated 66. The housing supports the interchangeable ink fountain assemblies 14 and supports and houses various components of the interchangeable ink fountain system hereinafter described.

More particularly, ink fountain 14 is removably mounted at the "head" of preparation station 64 by interconnections similar to that described above in relation to FIGS. 1–3 of duplicating machine 10. All of the interconnections are not shown in the drawings to avoid mere duplication and to avoid cluttering the illustrations. For instance, a hand crank 20' is illustrated in conjunction with gears 52' and 54', similar to FIG. 3. Motor means are provided within the upper portion of housing 66 to drive the gears similar to the normal driven interconnections of the duplicating machine. Conventional override clutch means is provided between hand crank 20' and the gears to permit fast rotation of ink fountain roller 16 during a cleaning operation.

Housing 66 of preparation station 64 includes a lower enclosure, generally designated 68 for storing a plurality of ink fountain assemblies 14. To this end, a plurality of flanges 70 are horizontally disposed in vertically spaced relationship within the housing to form shelf supports. The enclosure is divided by a vertical partition 72. However, it can be seen that the interior spaces on opposite sides of the partition are open in a vertical direction. A trough 74 is disposed at the bottom of each space on opposite sides of partition 72. These troughs are removable and are provided for containing moisture means to prevent any ink in a stored ink fountain from drying. In the exemplary embodiment, the moisture means comprise porous or sponge-like components 76 positioned in troughs 74. Moisture, such as water, can be supplied to the troughs and absorbed by the sponges to thereby maintain a given moisture level within enclosure 68. An access door 78 is hinged to housing 66 and a sealing gasket 80 is provided on the housing about the door opening to facilitate sealing enclosure 68 to contain moisture therein.

The interchangeable ink fountain system includes a plurality or set of tray-like holders, generally designated 82 for supporting and transporting ink fountains between preparation station 64 and duplicating machine 10. Each transport tray includes outwardly facing U-shaped flanges 84 at opposite ends thereof. These flanges provide handles for an operator to carry the transport tray and a supported ink fountain assembly. Shelf flanges 70 within enclosure 68 are adapted for supporting transport trays 82 with their respective ink fountains.

Preparation station 64 has platforms for positioning multiple transport trays and/or ink fountain assemblies during various work at the preparation station. More particularly, an upper platform 86 is provided with guide rails 88 for cooperating with the U-shaped flanges of transport trays 82. Therefore, a transport tray can be properly positioned on platform 86 while its respective ink fountain assembly is positioned for adjustment, cleaning and filling at the preparation station, as illustrated in FIG. 4. A lower platform 90 also is provided for holding one or more transport trays and respective ink fountain assemblies.

Preparation station 64 is provided with means for facilitating easy adjustment of the ink flow-through gap of an ink fountain assembly 14 prior to filling the fountain with ink and prior to mounting the ink fountain on the duplicating machine. It should be understood that costly down time in operating duplicating machines, such as those described herein, not only results from the very fact of changing ink colors or types, with the resulting cleaning and other necessary operations, but the ink fountain must be adjusted for applying the proper amount of ink for a given job.

Specifically, FIGS. 5 and 6 show the various components of a standard ink fountain assembly, including fountain roller 16 and side walls 22. Each ink fountain assembly includes a fountain trough defined by an elongated blade 90 extending along one side of the trough and ink fountain roller 16 extending along the other side of the trough. The blade is mounted on a frame 92 supported between end walls 22. The blade is secured to frame 92 by a plurality of threaded fasteners 94 (FIG. 6). As is known, a plurality of thumb screws 96 are threaded through frame 92 whereby the distal ends of the screws angularly abut against the underside of blade 90, as best seen in FIG. 5. By adjusting the screws, a gap "G" between blade 90 and roller 16 can be varied along the length of the roller to vary the amount of ink applied to the printing couple. For instance, referring to FIG. 6, it can be seen that gap "G" has been adjusted along the roller and includes wider gap portions "G1" and narrower gap portions "G2".

In order to facilitate adjusting gap "G" preparatory to mounting an ink fountain assembly on the duplicating machine, light means in the form of a fluorescent tube 98 (FIGS. 4 and 5) is disposed within housing 66 behind ink fountain 14 for directing light through gap "G" whereby an operator can readily visualize the gap dimensions during adjusting of thumb screws 96. Heretofore, this adjusting operation was not performed until the ink fountain was mounted on the duplicating machine. Normal lighting conditions do not permit very accurate adjustment. Consequently, an operator usually runs the duplicating machine through a considerable number of copy sheets while making adjustments of the ink flow-through gap. This has always been a cumbersome and time-consuming trial-and-error procedure, further adding to down time of the machine when changing types or colors of ink.

Ink fountain preparation station 64 also includes additional features to facilitate adjustment of the ink fountain. First, and referring to FIGS. 4 and 7, easel means 100 are provided at the top of housing 66, immediately behind a mounted ink fountain assembly 14. The easel means is provided for supporting a master, test plate or the like 102 whereby an operator can readily compare the gap dimensions "G1", "G2" with the ink requirements of the master. Specifically, any given master has varying areas lengthwise thereof (in the direction of feeding) which obviously will require more ink than other linear areas of the master. By having the master or a facsimile of the master in juxtaposition to an ink fountain being adjusted, an operator can rapidly become proficient in observing the clearance dimensions of the flow through gap, with the ink requirements of the master facilitated by light means 98 immediately behind the ink fountain being adjusted.

A second feature is the provision of gauge means on housing 66 for comparison by an operator with the gap dimensions of the ink fountain. This is illustrated in FIGS. 7 and 8 and comprise a plurality of window-like slots 104 formed through housing 66 with light means 98 therebehind. The light emanating from the light means passes through the slots and is easily readable by an operator. As shown in FIG. 8, the slots are of progressively changing widths. Appropriate indicia means 106 are provided adjacent each slot representative of any particularly calibration to which the operator is accustomed. Obviously, the width of any given slot can be easily compared to the given gap width at any point along the fountain roller. The indicia means may be calibrated to indicate a given amount of ink flow necessary to cover a given density on master 102. For instance, master 102 shown in FIGS. 4 and 7 actually comprises a test plate which can be used for instructional purposes. It can be seen that a pattern 108 on the master or test plate is in the form of a simple stepped configuration. This pattern can be used for training operators to become accustomed to the density of ink which would be applied by a gap of a given width. The steps on pattern 108 obviously corresponding to the width of slots 104.

Lastly, preparation station 64 includes a number of utensil holders on the outside of housing 66 for supporting various implements or other accessories used in preparing an ink fountain for operation. This is shown in FIG. 7. A compartment 108 is provided for storing a plurality of cleaning strips 110 used to remove ink from an ink fountain. A compartment 112 is provided for storing smaller spatula strips 114 used in scraping residue ink off of the fountain roller itself. A platform 116 is provided for holding a solvent dispenser 18. A slotted holder 120 is provided for storing knife utensils 122.

In view of the foregoing, it can be seen that I have provided a new and improved system for interchangeable ink fountains in duplicating machines, such as offset lithographic machines. A plurality of ink fountains are used in conjunction with a duplicating machine and a novel preparation station. Complementary interengaging means are provided on each ink fountain and each of the duplicating machine and preparation station for selectively and removably mounting an ink fountain on either the duplicating machine or the preparation station. This system reduces machine down time between printing runs to a bare minimum. In fact, the ink fountain on the duplicating machine can be interchanged in the shortest time possible, i.e., only that time required for running a printing couple with cleaning solvents applied to the rollers or cylinders thereof, usually on the order of 70 seconds. All of the work heretofore necessary for removing previous ink from an ink fountain, cleaning the ink fountain, adjusting the ink fountain, reloading the fountain with ink and/or mixing various ink components are performed at a separate ink fountain preparation station while a previous "run" is being performed at the duplicating machine. Aids are provided at the preparation station for substantially adjusting the ink fountain to a given master, or the like, prior to a given ink run and thereby eliminating trial-and-error procedures heretofore prevalent.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A preparation station for ink fountains used in duplication machines, such as rotary offset lithographic machines, the ink fountain including a fountain trough defined by an elongated blade, an ink fountain roller and means for adjusting the ink flow-through gap between the blade and roller, comprising:

a housing independent of the duplicating machine;

support means for removably mounting an entire ink fountain on the housing in position for ready access to said adjusting means;

light generating means on the housing behind the ink fountain for directing light through said gap whereby an operator can readily visualize the gap dimensions while adjusting the same preparatory to installing the preadjusted ink fountain in the duplicating machine; and easel means on said housing adjacent the ink fountain for supporting a master, whereby an operator can readily compare the gap dimensions with the ink requirements of the master.

2. The preparation station of claim 1, including drive means on said housing for rotating the roller of the ink fountain when mounted on the housing.

3. The preparation station of claim 2 wherein said drive means include motor means for power driving the roller.

4. The preparation station of claim 3 wherein said drive means include manual means for rotating the roller independently of said motor means.

5. The preparation station of claim 1, including enclosure means on said housing for storing at least one ink fountain when not in use.

6. The preparation station of claim 5 wherein said enclosure means includes a plurality of shelves for supporting a plurality of ink fountains.

7. The preparation station of claim 5, including moisture means in said enclosure means to prevent any ink in a stored ink fountain from drying.

8. The preparation station of claim 7, including seal means for sealing said enclosure means to contain moisture therein.

9. The preparation station of claim 8, including an access door to said enclosure means and sealing gasket means about the access door.

10. The preparation station of claim 1, including platform means on the front of said housing for supporting at least one ink fountain independently of said support means.

11. In combination with the preparation station of claim 1, at least one tray-like holder for carrying an ink fountain between the preparation station and the duplicating machine.

12. The combination of claim 11, including platform means on the front of said housing and rail means for positioning said tray-like holder on the platform means whereby the ink fountain can be readily removed from the holder and positioned on said support means.

13. The preparation station of claim 1, including a plurality of utensil holders on the outside of said housing for supporting various implements used in preparing an ink fountain for operation.

14. The preparation station of claim 1, including gauge means on said housing for comparison by an operator with the gap dimensions of the ink fountain.

15. The preparation station of claim 14 wherein said gauge means comprises a plurality of window-like slots in the housing with said light means therebehind, the slots being of varying widths.

16. An interchangeable ink fountain system for use in duplicating machines, such as offset lithographic machines, comprising:

a plurality of ink fountains each including a fountain trough defined by an elongated blade, an ink fountain roller and means for adjusting the ink flow-through gap between the blade and roller, a duplicating machine;

a preparation station, including a housing, independent of the dulicating machine;

complementary interengaging means on each ink fountain and each of the duplicating machine and preparation station for selectively and removably mounting an ink fountain on either the dulicating machine or the preparation station;

light generating means on the housing behind the ink fountain for directing light through said gap whereby an operator can readily visualize the gap dimensions while adjusting the same preparatory to installing the pre-adjusted ink fountain in the dulicating machine; and easel means on said housing adjacent the ink fountain for supporting a master, whereby an operator can readily compare the gap dimensions with the ink requirements of the master.

17. The system of claim 16 wherein said preparation station includes means for rotating a roller of the ink fountain when mounted at the station.

18. The system of claim 16 wherein said preparation station includes light means behind a mounted ink fountain for directing light through said gap whereby an operator can readily visualize the gap dimensions while adjusting the same.

19. The system of claim 18, including gauge means on said housing for comparison by an operator with the gap dimensions of the ink fountain.

20. The system of claim 19, wherein said gauge means comprise a plurality of window-like slots in the housing with said light means therebehind, the slots being of varying widths.

21. The system of claim 16, including drive means on said housing for rotating the roller of the ink fountain when mounted on the housing.

22. The system of claim 21 wherein said drive means include motor means for power driving the roller.

23. The system of claim 16, including enclosure means on said housing for storing at least one ink fountain when not in use.

24. The system of claim 23, including moisture means in said enclosure means to prevent any ink in a stored ink fountain from drying.

25. In combination with the system of claim 16, at least one tray-like holder for carrying an ink fountain between the preparation station and the duplicating machine.

26. The system of claim 25, including a plurality of utensil holders on the outside of said housing for supporting various implements used in preparing an ink fountain for operation.

* * * * *